US005527040A

United States Patent [19]

Stanley et al.

[11] Patent Number: 5,527,040

[45] Date of Patent: Jun. 18, 1996

[54] WRIST SPLINT AND STABILIZER

[75] Inventors: Carol A. J. Stanley, Collingswood, N.J.; Anthony J. Wirtel, Canandaigua, N.Y.

[73] Assignee: Stash, Inc., Collingswood, N.J.

[21] Appl. No.: 495,904

[22] Filed: Jun. 28, 1995

[51] Int. Cl.[6] ..... A63B 69/36

[52] U.S. Cl. ..... 473/213; 273/DIG. 30; 473/62

[58] Field of Search ..... 273/189 R, 189 A, 273/188 R, 187.2, DIG. 30; 434/252; 473/61, 62

[56] References Cited

U.S. PATENT DOCUMENTS

| | | | |
|---|---|---|---|
| 3,606,343 | 9/1971 | Lemon | 273/189 R |
| 4,017,086 | 4/1977 | Washburn | 273/189 R X |
| 5,005,833 | 4/1991 | Groveman et al. | 273/189 R X |
| 5,064,198 | 11/1991 | Szabo | 273/189 R |

*Primary Examiner*—George J. Marlo
*Attorney, Agent, or Firm*—Eugene E. Renz, Jr.

[57] ABSTRACT

A golf training device for eliminating palm reflection of the trailing hand during a golf swing including a support member positionable on the dorsal side of the wrist and forearm of the wearer and secured there with one strap encircling the wrist and a second strap encircling the forearm. A bracket is attached to the support which includes an A-frame extending away from the dorsal side of the wrist and forearm. An adjustable cord is provided which attaches to the A-frame and includes a loop for encircling at least one finger of the trailing hand of the wearer. The length of the cord is adjusted such that the trailing hand of the wearer can move his or her hand from dorsal flexion to extension. However, further movement from extension into palmer flexion is resisted. By transverse resistance through the club to the lead hand, the wrist of the lead arm is signaled not to move into dorsal flexion or collapse. By keeping both wrists in substantial extension, the club face is oriented such that it is square to the target in the hitting zone.

14 Claims, 7 Drawing Sheets

WRIST SPLINT AND STABILIZER

BACKGROUND OF THE INVENTION

1. Field of the Invention

The present invention relates to wrist stabilizing devices and, more particularly, to a device which, when employed in making a golf swing, encourages the lower hand gripping the club to not move past extension and into flexion as the hands move into and through the hitting zone.

2. Brief Description of the Prior Art

In golf, the hands play a critical role in controlling the position of the club face as it moves through the hitting zone and contacts the ball. Experts and experienced golfers advise that the hands must be firm, but not so firm as to be "choking" the club. In addition, golfers are often taught that the only pressure points in the hands, for right-handed persons, should be the last three fingers of the left hand and the index finger of the right hand as it wraps or curls around the club in a position similar to that of pulling a trigger. In addition to these pressure points, both wrists need to be in a neutral position such that the hands (not the fingers) are anatomically extended. This "neutral alignment" maximizes the ability to create optimum contact with the ball where the club face is square to the target line.

There are a variety of devices known in the prior art which attach to the hands, wrists, and/or forearms of the user, and which are intended to help train the user to make a more correct golf swing. One such device is taught in U.S. Pat. No. 3,606,343 to Lemon. Lemon discloses a wrist restraint for golfers and bowlers. When used by a golfer, the restraint is worn on the lead hand, or the left hand of a right-handed golfer. The device includes a wrist band having a pair of elastic loops extending therefrom which are fitted around the user's middle and ring fingers to provide a wrist and hand tensioning device. Lemon also suggests that a second tensioning device may be worn by the golfer on his or her right hand. When worn on the right hand, the loops are stretched across the palm of the hand, such that the tensioning supplied by the elastic loops would urge the hand toward flexion.

U.S. Pat. No. 5,064,198 to Szabo teaches a device to be used by a golfer on his or her trailing hand during the putting stroke to lock the wrist in a slightly flexed position such that the lead wrist will not easily break during the putting stroke.

U.S. Pat. No. 3,408,077 to Norwood teaches a wrist restraining device which is apparently intended to be worn on the golfer's lead hand. The object is to prevent the wrist from bending backwards during the stroke.

Various other training devices have been developed to be worn on the hands and wrists of tennis players. One such device is taught in U.S. Pat. No. 5,005,833 to Groveman, et al. Such device includes an elastic wristband to be worn about each wrist with a strap connecting the two bands such that the arms must move substantially in unison. A thong or loop extends from each of the wristbands and circle the respective middle fingers of each hand, such that palm or flexion of each hand is restricted.

Other wrist support devices for tennis players are described in U.S. Pat. No. 4, 183,098 to Knowles, Jr. and U.S. Pat. No. 4, 176,839 to Pinkus.

SUMMARY OF THE INVENTION

It is therefore an objection of the present invention to provide a device for stabilizing the wrist of the trailing hand of the golfer during the golf swing.

Another object of the present invention is to provide a device which prevents palmar flexion of the trailing hand of a golfer as the hands enter and pass through the hitting zone.

Numerous other features, objects and advantages of the present invention will become readily apparent upon a reading of the detailed description and a review of the drawings provided herein. These features, objects and advantages of the present invention are accomplished through the use of a frusto-conical elastic member for placement around the wearer's wrist and forearm. The elasticity of the frusto-conical member is preferably in one direction only, such that the frusto-conical member can be stretched radially, but not axially. This allows the frusto-conical member to be pulled over the hand of the wearer as it is placed in its operable position encircling the wrist and forearm. The compression provided by the elastic frusto-conical member to the wrist of the wearer is not sufficient to restrict flexing of the wrist. Rather, the frusto-conical member provides a means for positioning the device on the wrist and forearm so that the other elements of the invention may more easily be manipulated by the left or free hand of the wearer. Mounted to the dorsal side of the frusto-conical member is a rigid, bridge-like bracket or A-frame. An adjustable cord extends from the A-frame toward the fingers of the trailing hand. Preferably, the cord is looped around the ring finger and middle finger and the length of the cord is adjusted, such that the hand can move from dorsal flexion to full extension. However, movement of the hand from extension to palmar flexion is resisted.

Extending substantially circumferentially about the frusto-conical member are a pair of anchor straps which are non-elastic. The anchor straps are provided with fastening means, such that they can be pulled snugly about the wearer's wrist and forearm to lock the device of the present invention in its operable position. In such manner, the frusto-conical member is not permitted any substantial movement longitudinally along the wrist and forearm of the wearer, nor is the frusto-conical member permitted to stretch radially when the anchor straps are so positioned.

The compression exerted by the anchor strap about the wrist does provide some limited resistance to palmar flexion. However, it is the cord extending from the A-frame and looping about fingers of the wearer, which prevents any substantial palmar flexion of the trailing hand. The cord, of course, does nothing to prevent dorsal flexion of the hand.

Generally speaking, and for the purposes of this application, all parts of the body are considered to be in extension when the body is in the anatomic position. This includes the hands. If, from the anatomic position, the wrist is flexed such that the hand is bent backwards, causing the palm of the hand to face the floor, this is referred to herein as dorsal flexion. When the wrist is flexed from the anatomic position such that the hand is positioned palm up, this is referred to herein as palmar flexion.

It has been found that the device of the present invention causes corrective action to be applied to both hands and thus, ultimately, to the club face, due to a principle called transverse resistance. The trailing hand is allowed to move from dorsal flexion to extension as it enters the hitting zone. Further movement of the trailing hand into palmar flexion is, however, prevented. When the right hand maintains its extended or neutral wrist position, it will also control the club. This trailing hand control keeps the club face square through the hitting zone. Restraining movement of the trailing hand from the neutral or extended position imparts a force to the left wrist through the club which both hands are gripping, thereby restraining the left wrist from dorsal flexion or collapse. In such manner, the device of the present invention encourages both wrists to move to a position of extension, the position which causes the club face to enter the hitting zone square to the target line. Golf teaching professionals often refer to the wrists as being neutral when, anatomically, the wrists are in extension.

DETAILED DESCRIPTION OF THE PREFERRED EMBODIMENT

Figure 1:
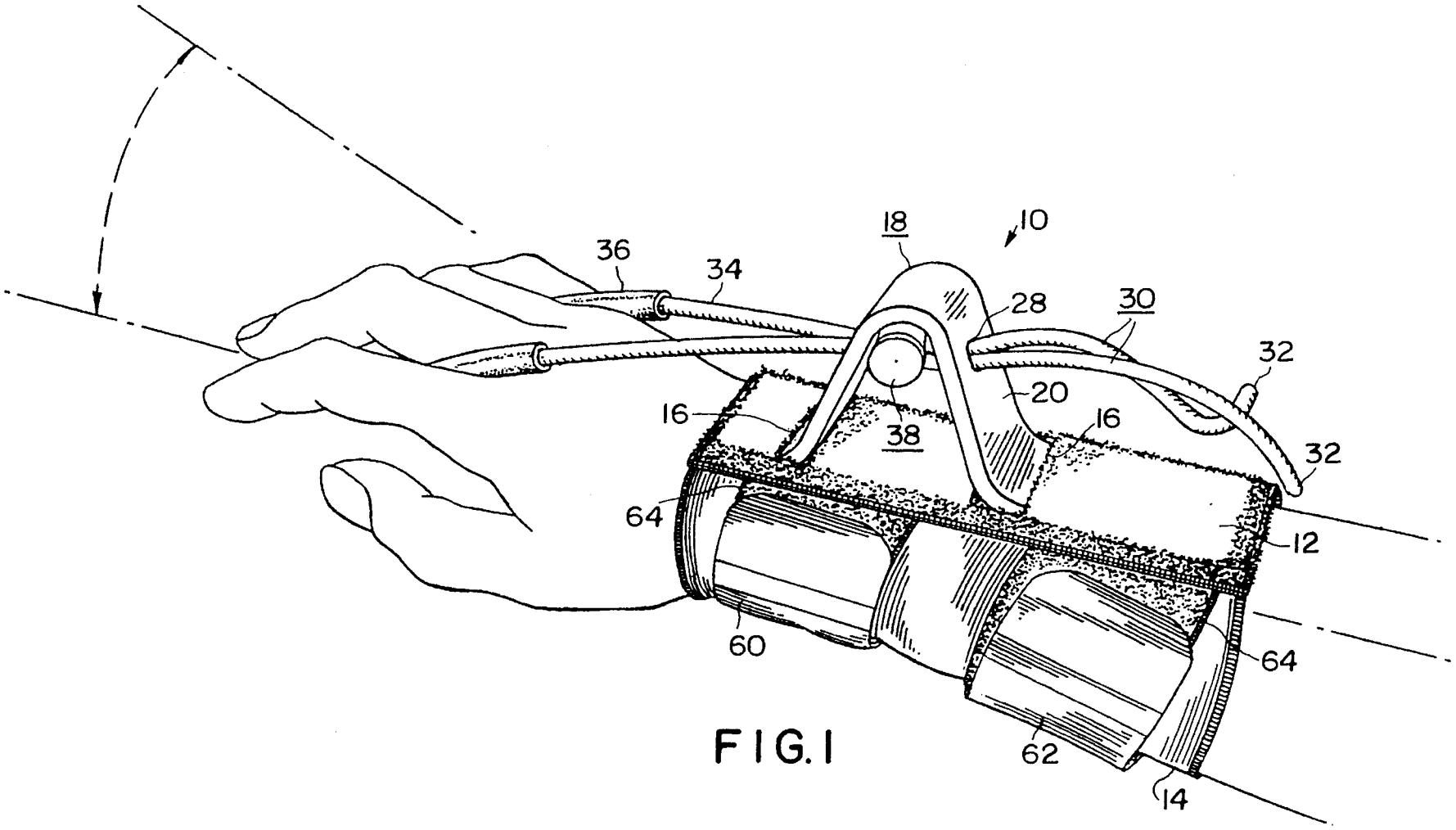
FIG. 1 is a perspective view of the wrist splint and stabilizer of the present invention secured to the right wrist and forearm of a golfer.

Turning first to FIG. 1 there as shown, the golf training device 10 of the present invention as worn on the right wrist and forearm of a right handed golfer. For the purposes of this application, the left hand of a right-handed golfer will be referred to as the lead hand and the right hand will be referred to as the trailing hand. With a left-handed golfer, the reverse would be true. The golf training device 10 includes a flexible platform or support member 12, preferably made from a durable fabric. Attached to the flexible platform member 12 is a substantially frusto-conical elastic member 14. Elastic member 14 may have two way stretch, meaning that it can stretch longitudinally along its cylindrical axis and radially. By stretching radially, it is meant that the frusto-conical elastic member 14 stretches to allow its circumference to increase. Preferably, elastic member 14 has only a one way stretch capability allowing it to be stretched radially. The flexible platform member 12 is attached to frusto-conical elastic member 14 preferably by sewing. There are a pair of transverse slits or slots 16 in flexible platform member 12.

Figure 7:
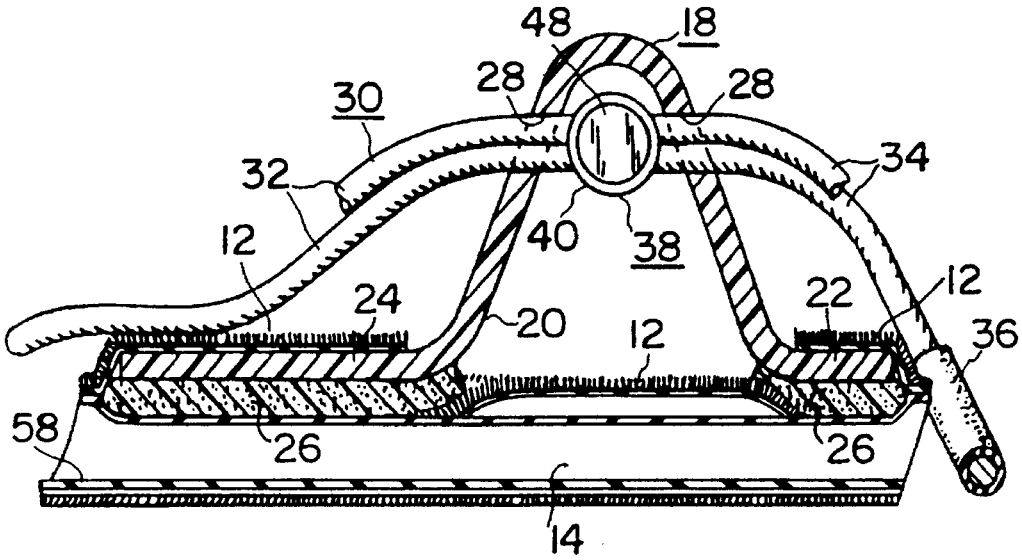
FIG. 7 is a sectional view taken along line 7—7 of FIG. 4.
Figure 9:
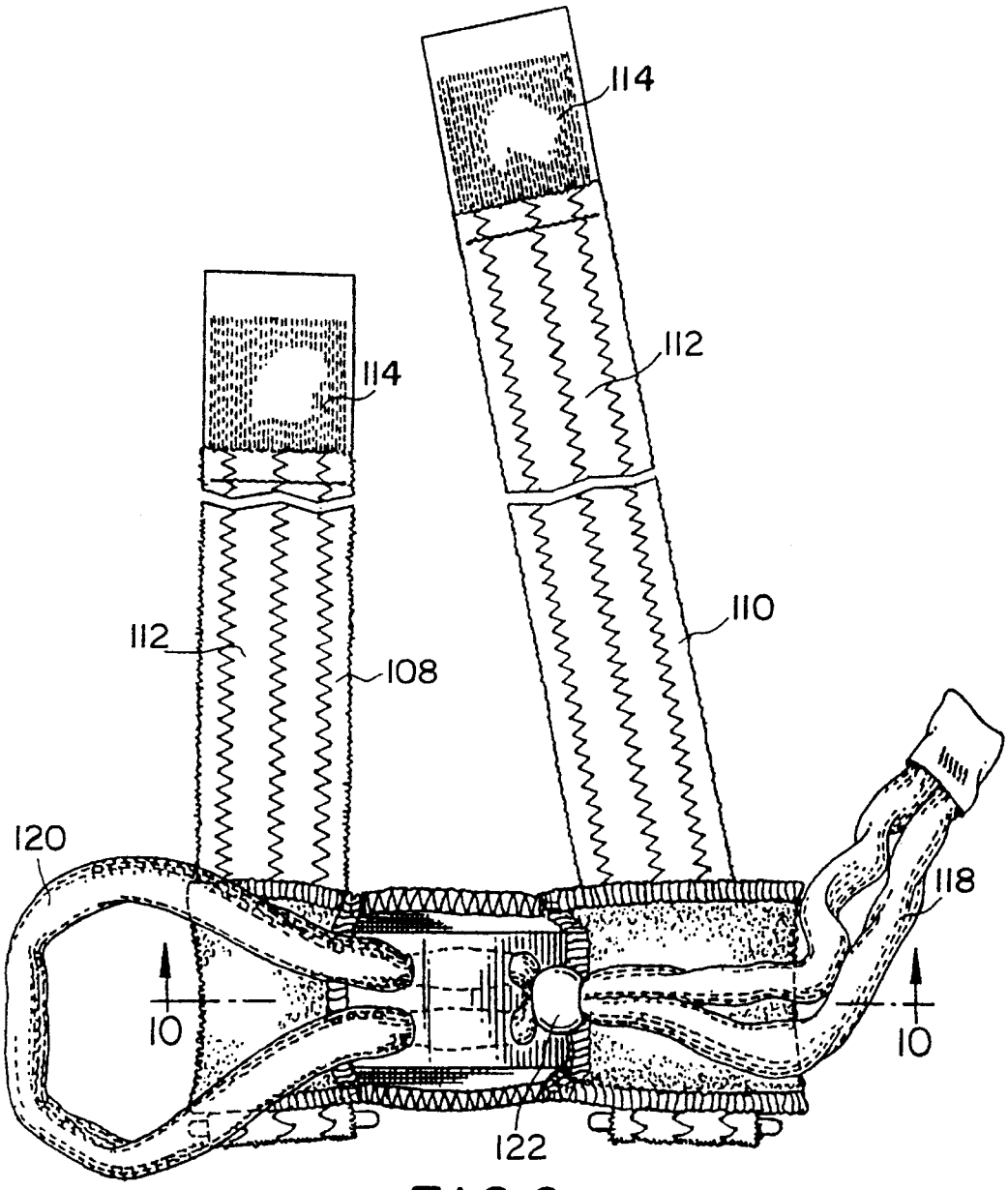
FIG. 9 is a top plan view of the alternative embodiment depicted in FIG. 8.
Figure 8:
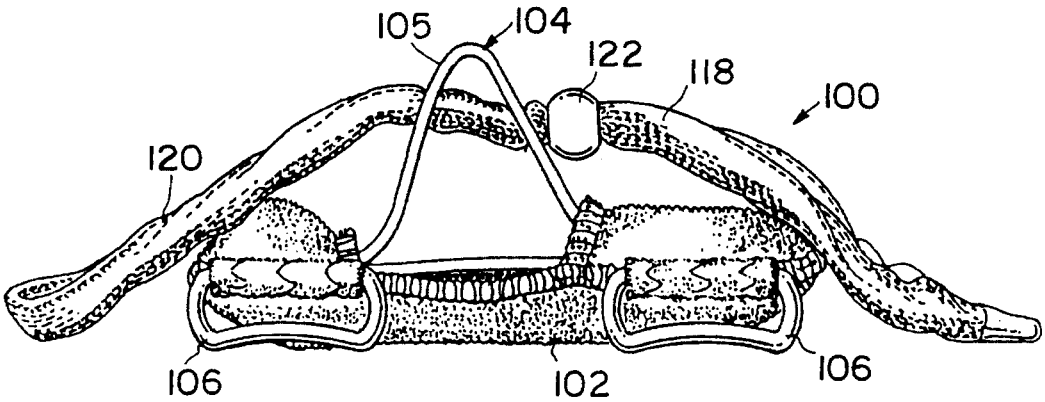
FIG. 8 is a side elevation of an alternative embodiment of the present invention.

There is a bracket 18 which includes an A-frame member 20, a front plate member 22, and a rear plate member 24. Slits 16 create a front envelope and a rear envelope between flexible platform member 12 and frusto-conical elastic member 14 (see FIG. 7). Front plate member 22 resides in the front envelope and rear plate member 24 resides in the rear envelope, thereby securing bracket 18 to flexible platform member 12. For purposes of comfort, cushions 26 may be provided to reside beneath front plate member 22 and rear plate member 24. For added comfort the cushions 26 may wrap around the distal ends and across the top surfaces of plate members 22, 24. Such cushions may be of any suitable material such as urethane foam. The cushions 26 are preferably secured within the front and rear envelopes, but could also be positioned outside of such envelopes such that they would reside between frusto-conical elastic member 14 and the wrist and forearm of the wearer.

There are a pair of orifices 28 through A-frame member 20. Passing through both orifices 28 is cord 30. Cord 30 is preferably a braided nylon or polypropylene cord having no substantial stretch. Both ends 32 of cord 30 pass through both orifices 28 such that a loop 34 is created on the front side of A-frame member 20. Loop 34 may be provided with a piece of flexible tubing 36, such as surgical tubing for purposes of comfort when the loop 34 is encircled about one or more fingers of the wearer, as shown in FIG. 1. It will be appreciated that cord 30 may take some structural form other than a cord. For example, cord 30 may have a structure similar to an enlarged lace for athletic shoes. In such instance, because of the relative softness of a shoelace-type structure, the need for flexible tubing 36 will likely be obviated.

Figure 5:
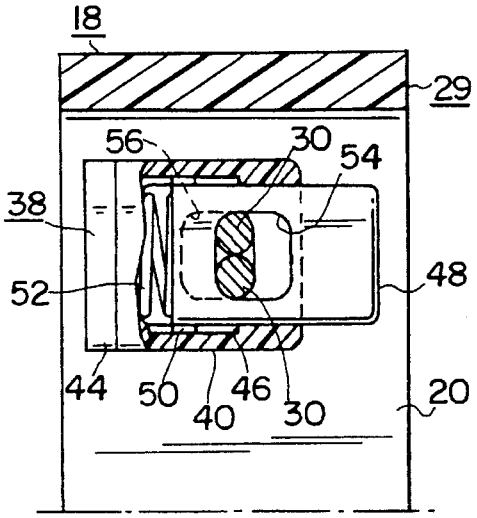
FIG. 5 is a partial sectional view taken along line 5—5 of FIG. 3.

Residing beneath or within A-frame member 20 is clamp 38. Clamp 38 is a commercially available locking device available from Plas-Tech of Denver, Colo. Such a product from Plas-Tech is marked with U.S. Pat. No. 4,328,605. Referring to FIG. 5, clamp 38 includes a substantially cylindrical housing 40 having an open end 42 and a capped end 44. Cylindrical housing 40 further includes an annular ledge 46. Residing partially within cylindrical housing 40 is piston 48. Piston 48 includes an annular lip 50. Annular lip 50, in conjunction with annular ledge 46, creates a travel stop preventing piston 48 from exiting through the open end 42 of cylindrical housing 40. Piston 48 is biased to a position where annular lip 50 abuts annular ledge 46 by means of coil spring 52. There are a pair of substantially rectangular orifices 54 through piston 48. There are a pair of substantially identical orifices 56 through cylindrical housing 40. A user can depress piston 48, thereby overcoming the bias of spring 52 to place orifices 54 in alignment with orifices 56. When orifices 54 are in alignment with orifices 56, cord 30 can be freely moved through such orifices to thereby allow the user to adjust the distance loop 34 can extend from the front side of A-frame member 20. When the user has adjusted cord 30 to its desired length, piston 48 is merely released with spring 42 biasing piston 48 such that orifices 54 and 56 are no longer in complete alignment with one another. Rather, alignment is only partial, with edges of the orifices 54, 56 pressing into and frictionally engaging cord 30, such that the cord 30 is substantially locked in that position.

Figure 2:
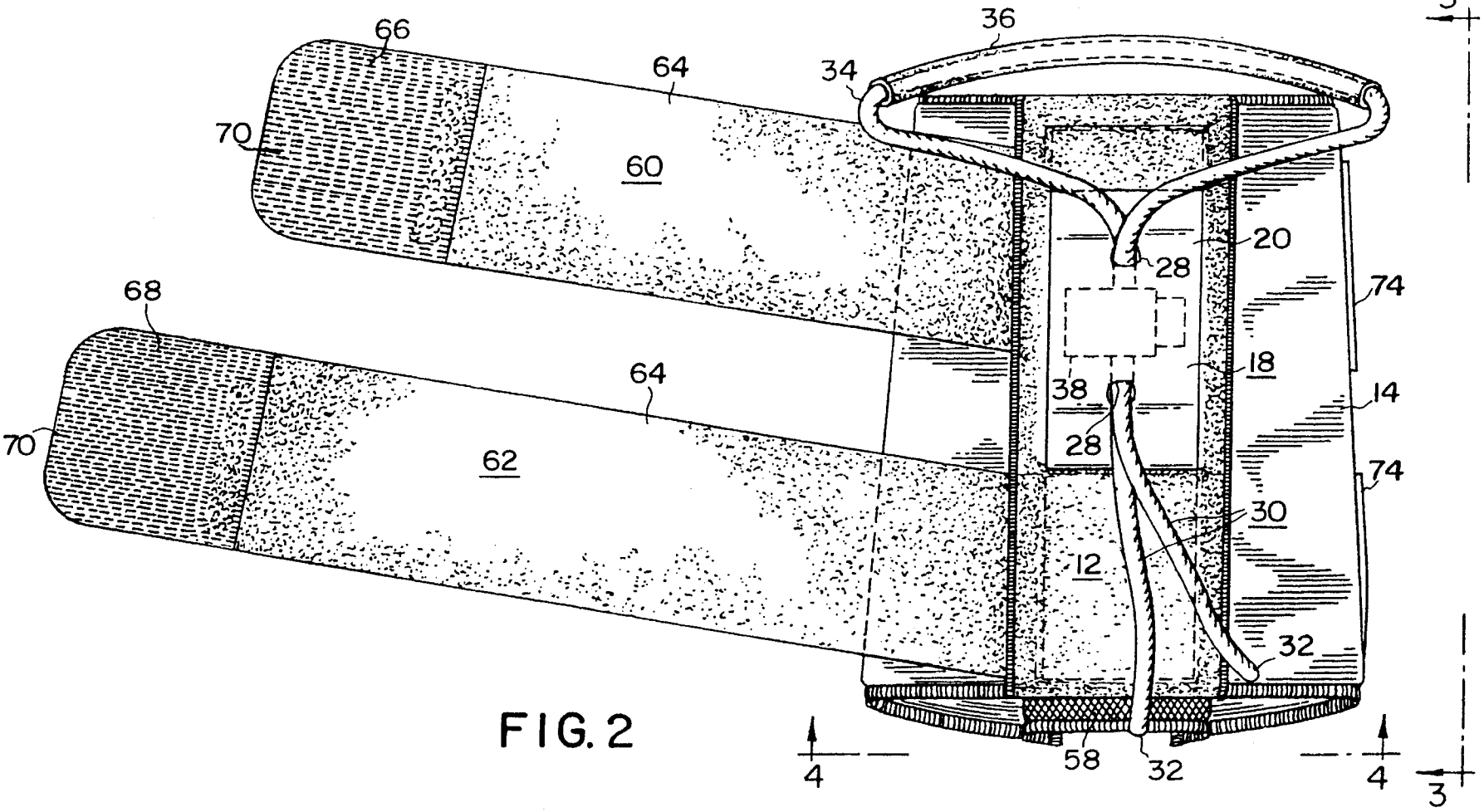
FIG. 2 is a top plan view of the wrist splint and stabilizer of the present invention.
Figure 3:
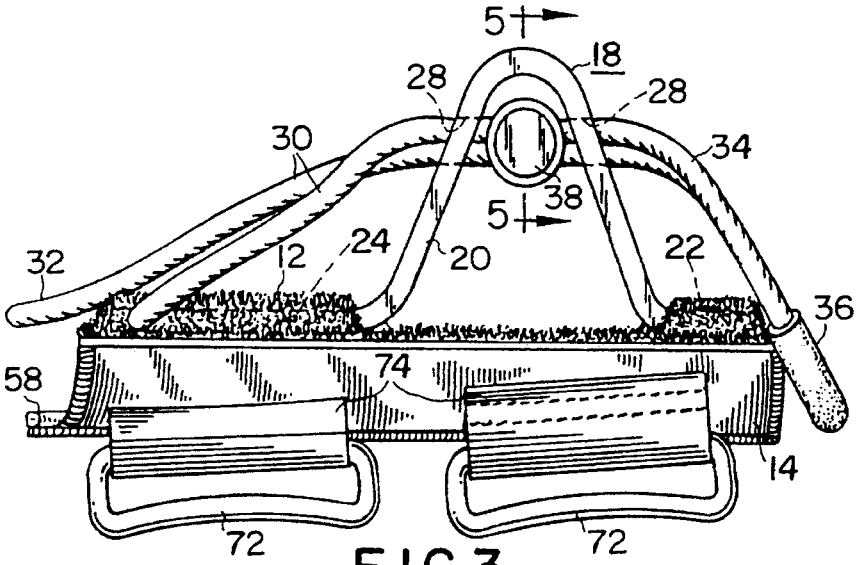
FIG. 3 is a side elevational view of the present invention as viewed from line 3—3 of FIG. 2.
Figure 4:
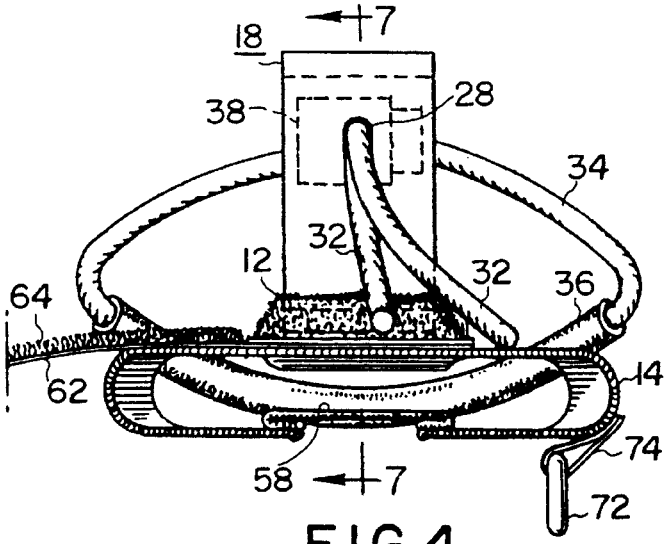
FIG. 4 is an end view of the device of the present invention as viewed from line 4—4 of FIG. 3.
Figure 6:
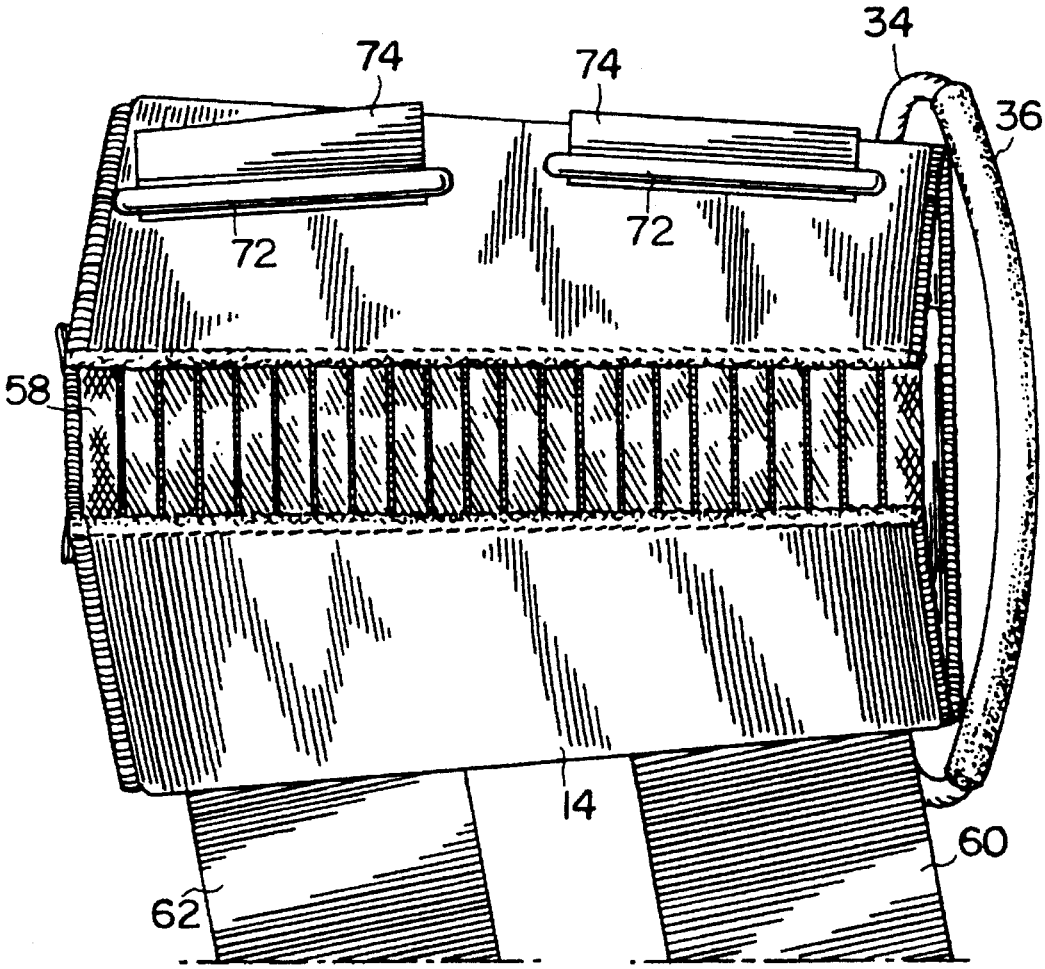
FIG. 6 is a bottom plan view of the present invention.

Looking next at FIGS. 4 and 6, the frusto-conical elastic member 14 includes an expansion section 58 which is also formed of an elastic material. The expansion section 58 adds comfort and allows for the frusto-conical elastic member 14 to more easily fit over the hand of the user so that it may be properly positioned around the wrist and forearm. Attached to flexible platform member 12 and extending therefrom are front strap 60 and rear strap 62 (shown most clearly in FIG. 2). Front and rear straps 60, 62 are preferably made from a non-elastic fabric and have a flexible loop surface 64. Attached to the distal end of front and rear straps 60, 62 are tongues 66, 68, respectively. Tongues 66, 68 each have a flexible hook surface 70. Flexible hook surfaces 70 are engageable with and disengageable from flexible loop surfaces 64. A common product of this type which may be acquired to perform this function is Velcro®. Other adjustable length fastening means such as buckles may also be used.

A pair of eyes or stirrups 72 are attached to the outside of elastic member 14 by means of fabric loops 74. Once the user has positioned the golf training device 10 of the present invention on his or her wrist and forearm, the device is secured there by means of front and rear straps 60, 62 in conjunction with eyes or stirrups 72 such that it is permitted no substantial movement. The tongues 66, 68 are inserted through eyes or stirrups 72 and pulled to a snug fit about the user's wrist and forearm. The tongue 66 is then folded back onto front strap 60, causing flexible loop surface 64 to engage flexible hook surface 70. Similarly, tongue 68 is folded back against rear strap 62 such that flexible loop surface 64 engages flexible hook surface 70. The front strap 60, which substantially encircles the wrist of the wearer, prevents any significant lateral movement of the device 10 of the present invention along the wrist and forearm of the wearer. The rear strap 62 which encircles the forearm also aids in preventing lateral movement.

In use, once the device 10 of the present invention is properly positioned and secured on the wrist and forearm of the wearer, loop 34 is encircled about the ring and/or middle fingers of the trailing hand. Through the use of clamp 38, the length of loop 34 is adjusted such that the user cannot move his or her hand beyond extension into palmar flexion. The device 10 of the present invention does nothing to limit dorsal flexion. In such manner, when the user grips a golf club and attempts to make a swing, the right hand will be allowed to move freely into dorsal flexion during the backswing. However, during the downswing, the right hand will not be permitted to move past full extension, which is the desired position in the hitting zone. This maintenance of the hand in the extended or neutral position in the hitting zone is also transmitted to the lead hand or left hand of a right handed golfer through the club, such that the wrist and hand of the lead arm are also maintained in the extended or neutral position. It will, of course, be appreciated that, although the hands are in extension, the fingers are in flexion, gripping the golf club. In such manner, device 10 of the present invention assists in causing the hands to work together to maintain the wrists and hands in extension through the pressure applied to the middle and ring fingers of the trailing hand, thereby squaring the club as it enters and passes through the hitting zone. Tests on a number of golfers of different skill levels were conducted to evaluate the efficacy of the present invention. In every case, the golfer was able to strike the ball more consistently with the club face squared to the target line, thereby resulting in a more consistent golf swing with generally greater distance and improved accuracy. The improvement to distance and accuracy of the shots is believed to be the result of the device 10 of the present invention ultimately helping the golfer put the club head in the proper orientation as it moved through the hitting zone.

In addition to aiding in the proper orientation of the wrists during a full swing, the present invention is particularly suited in aiding the user to develop a good chipping stroke. There is a tendency for amateurs to attempt short pitch or chip shots by bringing the club up and delivering it back to the ball with wrist flexion. The wrists should remain relatively firm and in extension during these short game shots. Movement of the trailing hand into palmar flexion for the short game shots, usually results in inconsistent and poor shots.

By using the device of the present invention as a training device, such as at a driving range, the muscles learn how to teach the hands how to come through the ball during the downswing and deliver the club face such that it is square to the target line at contact with the ball. Again, although the device 10 of the present invention is worn on the right wrist and forearm to prevent palmar flexion of the right hand, by transverse resistance through the club, the message is passed to the lead hand that the left wrist should not be allowed to collapse. Collapse of the lead wrist would allow the lead hand to move past extension and into dorsal flexion which would, in turn, orient the club face in the hitting zone such that it is not square to the target line.

It will be appreciated by those skilled in the art that front and rear plate members 22, 24 serve as bearing surfaces for A-frame member 20 and the forces exerted thereon through cord 30. Front and rear plate members 22, 24 serve not only as bearing surfaces in the direction toward the wrist and forearm of the wearer, but also away from the wrist and forearm of the wearer. Any force exerted by the hand of the wearer through cord 30 during the golf swing on A-frame member 20 would tend to cause rear plate member 22 to lift away from the forearm of the wearer. If rear plate member 24 was allowed to move away from the forearm of the wearer through pivoting action of the bracket 18, then the trailing hand would be allowed to move past extension and into palmar flexion. It is exactly that movement which the device 10 of the present invention is seeking to prevent. If the device 10 of the present invention was only made with the elastic member 14 and did not include the front and rear straps 60, 62, the device 10 would not be secure enough to prevent this type of pivoting action. It should be apparent to those skilled in the art that front and rear plate members 22, 24 could be formed as on continuous member extending completely across A-frame member 20.

Although as displayed in the drawings herein, cord 30 is depicted as a single length where both ends 32 are inserted through A-frame member 20 to form a loop 34, it will be appreciated by those skilled in the art that alternative embodiments of the cord structure may be practiced without departing from the scope of this invention. For example, a single end of the cord may be passed through the A-frame member 20 and the clamp 38 wherein the opposite end of cord has one or more preformed loops therein for encircling one or more fingers of the wearer. Thus, although with the preferred embodiment discussed herein, adjustment of cord 30 sets the total dimension of loop 34, in all cases, the critical dimension is the dimension from the A-frame member 20 to the end of loop 34 where it engages the fingers of the wearer.

Because A-frame member 20 extends away from the wrist and forearm of the wearer with the cord attached near the distal end thereof, the direction of the force transmitted through the cord to the fingers and hand of the wearer is at an angle greater than ninety degrees from the tangential direction that the hand would move in during palmar flexion. With any device wherein a cord was attached only to a wristband, such that the cord extended across the back of the hand, it will be appreciated that force exerted through the cord is perpendicular to the tangential direction of the hand when moving from extension into palmar flexion. Such a device would be much less effective in preventing palmar flexion of the trailing hand during a golf swing.

It will be appreciated by those skilled in the art that the elastic member 14 adds comfort to the device 10 when worn and allows for the user to more easily position the device 10 on his or her wrist and forearm. However, the golf training device 10 of the present invention may be practiced without elastic member 14. Such an alternative embodiment is depicted in FIGS. 8 through 11.

Although bracket 18 as discussed herein includes an A-frame member 20 it will be appreciated by those skilled in the art that A-frame member 20 can be replaced by any suitable structural member which extends from the base plate away from the dorsal side of the wrist and forearm. However, A-frame 20 as depicted offers light weight stability as well as rounded edges for safety.

Looking next at FIGS. 8 through 11 there is shown an alternative embodiment 100 to the golf training device of the present invention. The alternative embodiment includes a flexible base 102 preferably made from a durable, washable fabric. Attachable and detachable from flexible base 102 is bracket 104 which includes A-frame member 105. Affixed to one side of flexible platform or support member 102 are eyes or stirrups 106. Extending from the opposite side of support member 102 are front and rear straps 108, 110. Front and rear straps 108, 110 are preferably made from a non-elastic fabric and have a flexible loop surface 112. The distal ends of front and rear straps 108, 110 each have a flexible hook surface 114. Flexible hook surfaces 114 are engageable with and disengageable from flexible loop surfaces 112.

The front and rear sides of A-frame member 105 each have a pair of orifices 116 therethrough. There is a cord or lace member 118 which passes through orifices 16 thereby forming a loop 120 on the front side of A-frame member 105. There is a compression bead 122 through which both ends of cord or lace 118 pass. To adjust the length of loop 120, the user need merely slide the compression bead 122 along lace 118 to the desired position with compression bead 122 residing immediately adjacent the rear side of A-frame member 104.

Figure 10:
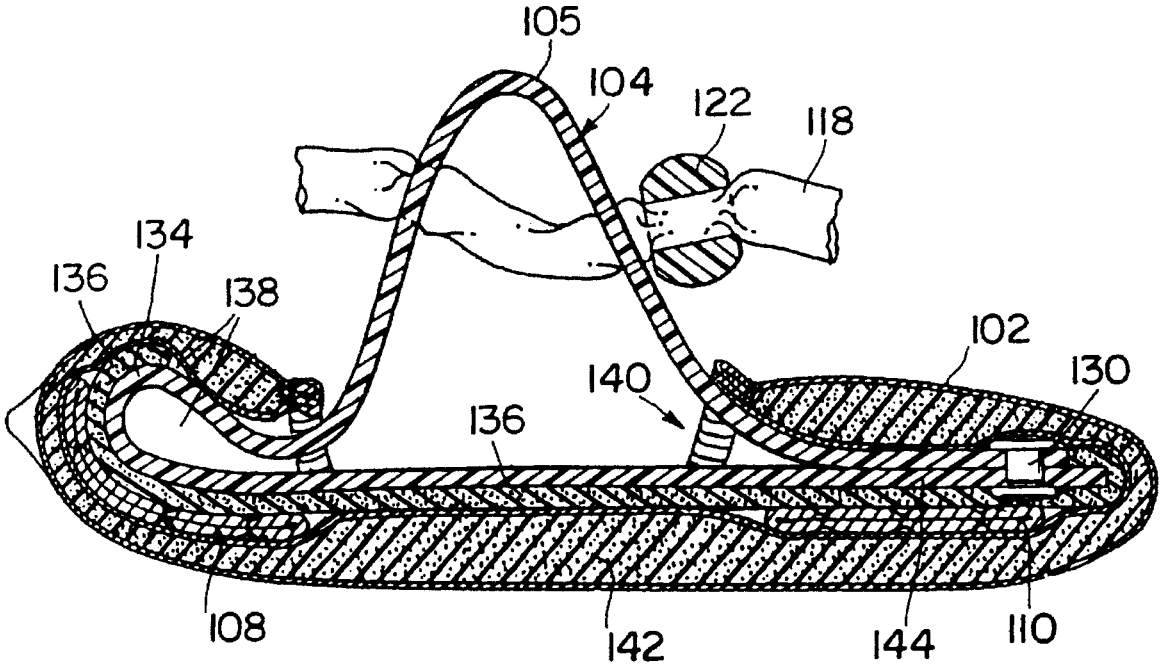
FIG. 10 is a cross-sectional view of taken along line 10—10 of FIG. 9.
Figure 11:
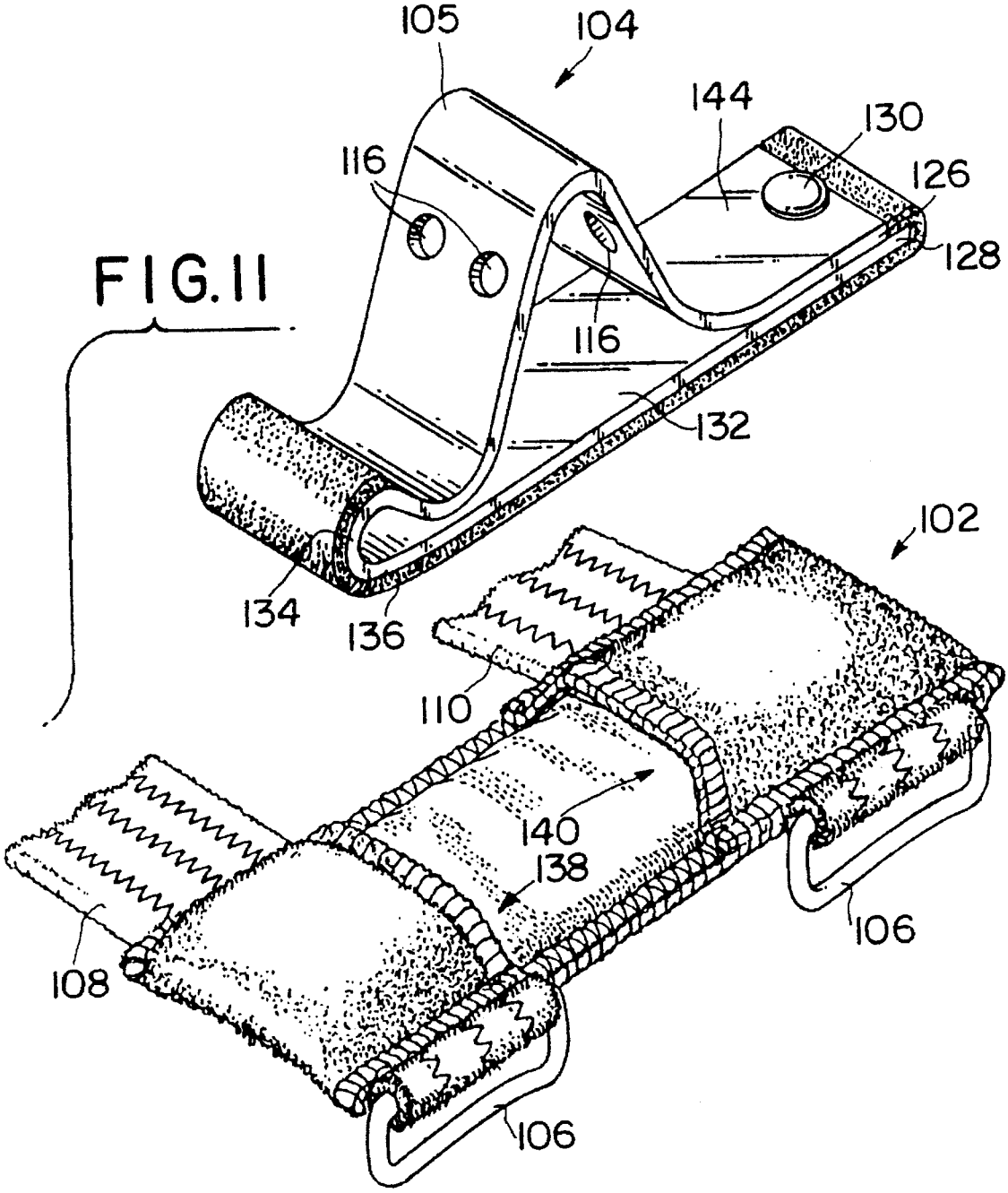
FIG. 11 is an exploded perspective view of the alternative embodiment: depicted in FIG. 8 with the cord not shown.

Referring specifically to FIG. 10 and 11, it can be seen that bracket 104 is made from a single member that is preferably formed from a semi-rigid material such as a plastic. Bracket 104 is thus formed such that the terminal ends 126, 128 thereof are located proximate to each other and fixed in that position by means of a rivet 130. Bracket 104 includes a planar base 132 which terminates on the rear side at terminal end 128. Planar base 132 serves the same function and purpose as front and rear plates 22, 24 as discussed above with reference to FIGS. 1 through 7. The front side of planar base 132 bends slightly upward away from the wrist of the wearer and then forms a bull-nose portion 134. The slight upward bend and the rounded shape of bull-nose portion 134 yields more comfort to the user as he or she moves the trailing wrist into dorsal flexion during the backswing. Adhesively affixed to A-frame member 104 is foam cushion 136.

Flexible support member 102 is fabricated such that it includes a front envelope 138 and a rear envelope 140. Contained within flexible support member 102 is cushion material 142. The rear portion 144 of bracket 104 resides in rear envelope 140 and the bull-nose portion 134 of bracket 104 resides in front envelope 138. In such manner, the user can remove bracket 104 from flexible support member 102 when desired, such as for washing or replacing flexible support member 102.

From the foregoing, it will be seen that this invention is one well adapted to obtain all of the ends and objects hereinabove set forth together with other advantages which are apparent and which are inherent to the device.

As many possible embodiments may be made of the invention without departing from the scope thereof, it is to be understood that all matter herein set forth and shown in the accompanying drawings is to be interpreted as illustrative and not in a limiting sense.

It will be understood that certain features and sub-combinations are of utility and may be employed with reference to other features and to sub-combinations. This is contemplated by and is within the scope of the claims.

What is claimed is:

1. A golf training device for limiting palmar flexion of the trailing hand during a golf swing comprising:

(a) a substantially frusto-conical member to be worn on the wrist and forearm of the user, said substantially frusto-conical member having a dorsal side and a palmar side;

(b) means for securing said substantially frusto-conical member to the wrist and fore arm of the user such that said frusto-conical member is permitted no substantial movement relative to the wrist and forearm of the user;

(c) bracket means affixed to said dorsal side of said substantially frusto-conical member and extending upward a substantial distance above said frusto-conical member;

(d) an adjustable cord attached to said bracket means including at least one loop means for encircling at least one finger of the trailing hand.

2. A golf training device for limiting palmar flexion of the trailing hand during golf swing as recited in claim 1 wherein:

said substantially frusto-conical member is made from an elastic material.

3. A golf training device for limiting palmar flexion of the trailing hand during golf swing as recited in claim 1 wherein:

said substantially frusto-conical member is made from an elastic material with one-way stretch such that said substantially member has the ability to stretch radially but not longitudinally.

4. A golf training device for limiting palmar flexion of the trailing hand during golf swing comprising:

(a) a support member;

(b) means for securing said support member to the dorsal side of the wrist and forearm of the wearer such that said support member is permitted no substantial movement relative to the wrist and forearm of the wearer;

(c) bracket means affixed to and extending upward a substantial distance above said support member;

(d) an adjustable cord attached to said bracket means including at least one loop means for encircling at least one finger of the trailing hand.

5. A golf training device for limiting palmar flexion of the trailing hand during golf swing as recited in claim 4 wherein:

said bracket means includes a frame section extending outward away from the wrist and forearm of the wearer.

6. A golf training device for limiting palmar flexion of the trailing hand during golf swing as recited in claim 5 further comprising:

clamp means engaging said adjustable cord for allowing the wearer to set the length of said adjustable cord from said bracket to said at least one loop means.

7. A golf training device for limiting palmar flexion of the trailing hand during; golf swing as recited in claim 6 wherein:

said adjustable cord attaches to said frame section of said bracket means.

8. A golf training device for limiting palmar flexion of the trailing hand during golf swing as recited in claim 5 wherein:

said adjustable cord attaches to said frame section of said bracket means.

9. A golf training device for limiting palmar flexion of the trailing hand during golf swing as recited in claim 5 wherein:

said bracket means includes a front plate member extending forward of said frame section and a rear plate member extending backward from said frame section.

10. A golf training device for limiting palmar flexion of the trailing hand during golf swing as recited in claim 2 further comprising:

clamp means engaging said adjustable cord for allowing the wearer to set the length of said adjustable cord from said bracket to said at least one loop means.

11. A golf training device for limiting palmar flexion of the trailing hand during golf swing as recited in claim 4 wherein:

said bracket means includes a rounded front portion in the area proximate to the wrist of the wearer.

12. A golf training device for limiting palmar flexion of the trailing hand during golf swing comprising:

(a) a support member;

(b) means for securing said support member to the dorsal side of the wrist and forearm of the wearer such that said support member is permitted no substantial movement relative to the wrist and forearm of the wearer;

(c) bracket means affixed to and extending upward a substantial distance above said support member, said bracket means including a frame section extending outward away from the wrist and forearm of the wearer;

(d) an adjustable cord attached to said frame section, said adjustable cord including at least one loop means for encircling at least one finger of the trailing hand;

(e) an adjustable cord attached to said bracket means including at least one loop means for encircling at least one finger of the trailing hand.

13. A golf training device for limiting palmar flexion of the trailing hand during golf swing as recited in claim 12 wherein:

said bracket means includes a rounded front portion in the area proximate to the wrist of the wearer.

14. A golf training device for limiting palmar flexion of the trailing hand during golf swing comprising:

(a) a substantially frusto-conical member to be worn on the wrist and forearm of the user, said substantially frusto-conical member having a dorsal side and a palmar side;

(b) means for securing said substantially frusto-conical member to the wrist and fore arm of the user such that said frusto-conical member is permitted no substantial movement relative to the wrist and forearm of the user;

(c) bracket means affixed to and extending upward a substantial distance above said dorsal side of said substantially frusto-conical member, said bracket means including a frame section outward from said substantially frusto-conical member;

(d) an adjustable cord attached to said frame section, said adjustable cord including at least one loop means for encircling at least one finger of the trailing hand.

* * * * *